US012140401B2

(12) United States Patent
Brady et al.

(10) Patent No.: US 12,140,401 B2
(45) **Date of Patent: *Nov. 12, 2024**

(54) FIREARM SLING AND PADDED REST

(71) Applicants: Patrick Brady, New Orleans, LA (US); Jeremy P. Sanders, Sammamish, WA (US)

(72) Inventors: Patrick Brady, New Orleans, LA (US); Jeremy P. Sanders, Sammamish, WA (US)

(73) Assignee: Patrick Brady, New Orleans, LA (US)

( * ) Notice: Subject to any disclaimer, the term of this patent is extended or adjusted under 35 U.S.C. 154(b) by 88 days.

This patent is subject to a terminal disclaimer.

(21) Appl. No.: 17/972,520

(22) Filed: Oct. 24, 2022

(65) Prior Publication Data

US 2023/0044207 A1 Feb. 9, 2023

Related U.S. Application Data

(63) Continuation-in-part of application No. 17/187,564, filed on Feb. 26, 2021, now Pat. No. 11,480,409.

(60) Provisional application No. 63/065,332, filed on Aug. 13, 2020.

(51) Int. Cl.
*F41C 33/00* (2006.01)
*F41A 23/02* (2006.01)

(52) U.S. Cl.
CPC ..... *F41C 33/002* (2013.01); *F41A 23/02* (2013.01)

(58) Field of Classification Search
CPC ..... F41C 33/002
USPC ..... 42/85, 91, 94
See application file for complete search history.

(56) References Cited

U.S. PATENT DOCUMENTS

| | | | | |
|---|---|---|---|---|
| 3,935,657 | A | 2/1976 | Wade | |
| 4,401,246 | A | 8/1983 | Dickinson | |
| 4,790,096 | A | 12/1988 | Gibson | |
| 5,018,652 | A | 5/1991 | Holtzclaw, Jr. | |
| 5,233,779 | A | 8/1993 | Shaw | |
| 5,642,584 | A | 7/1997 | Riggenbach | |
| 6,681,974 | B2 * | 1/2004 | Rotter | A45F 4/02 224/680 |
| 6,755,708 | B1 * | 6/2004 | McLarty | B63C 7/10 441/95 |
| 6,860,054 | B1 * | 3/2005 | Mosher | F41A 27/24 42/94 |
| 7,917,972 | B1 * | 4/2011 | Krueger | A41D 13/0151 2/459 |
| 10,890,406 | B1 * | 1/2021 | Whang | F41C 33/001 |
| 11,480,409 | B2 * | 10/2022 | Brady | F41A 23/06 |
| 2007/0094911 | A1 | 5/2007 | Rush | |
| 2012/0246991 | A1 * | 10/2012 | Seuk | F41C 33/001 42/94 |
| 2013/0081317 | A1 * | 4/2013 | Mangum | F41C 27/22 42/94 |

* cited by examiner

*Primary Examiner* — Bret Hayes
(74) *Attorney, Agent, or Firm* — FisherBroyles, LLP; Jason P. Mueller

(57) ABSTRACT

A firearm sling includes a shooting rest. The shooting rest may include a bifurcated cavity filled with deformable media. The bifurcated cavity defines a trough along at least a portion of a length of the shooting rest. The firearm sling may be coupled to a firearm to facilitate carrying the firearm over a shoulder or across a torso, the shooting rest providing padding for comfort in carrying the firearm as well as a support for the firearm to improve marksmanship.

5 Claims, 10 Drawing Sheets

FIREARM SLING AND PADDED REST

SUMMARY

This application is a continuation-in-part of U.S. patent application Ser. No. 17/187,564 filed on Feb. 26, 2021, which claims the benefit of U.S. Provisional Patent Application No. 63/065,332, filed on Aug. 13, 2020, the contents of both of which are incorporated herein by reference in its entirety.

A firearm sling may include a padded shooting rest, which may also double to provide cushioning when carrying the firearm.

According to some embodiments, a firearm sling includes a strap having a first end and a second end; a rest portion coupled to or integrated with the strap, the rest portion including top surface and a bottom surface, a trough, channel and/or a pair of lobes defined on the top surface of the rest portion. The rest portion is pliable allowing the rest portion to bend along its length in a first direction to allow the top surface to at least partially conform about a shoulder of a user, when carrying a firearm, and bend along the length in a second direction to at least partially conform to an underlying support contacting the bottom surface, when supporting the firearm in the channel or between the pair of lobes on the top surface. The rest portion may be formed integrally with the strap or may be a separate member attached to the strap.

According to some embodiments, a firearm sling includes a strap having a first end and a second end and an inflatable rest portion coupled to or integrated with the strap. The inflatable portion includes an internal chamber that may be inflated when desired. In some cases, a surface of the inflatable rest portion may when inflated define a trough, channel and/or a pair of lobes for defined on the top surface of the rest portion. The rest portion may be formed integrally with the strap or may be a separate member attached to the strap According to some embodiments, a firearm sling includes a strap having a first end and a second end; a rest portion coupled to or integrated with the strap, the rest portion including a bifurcated cavity formed along a length of the rest portion; and a media within the bifurcated cavity, the media forming a pair of lobes within the rest portion. The rest portion may be formed integrally with the strap or may be a separate member attached to the strap. The firearm sling may, in any embodiment, include a first attachment positioned near the first end, and a second attachment positioned near the second end, the first attachment and second attachment configured to selectively couple the firearm sling to a firearm.

In embodiments including a bifurcates cavity, such a bifurcated cavity may be formed in the rest portion from stitching along at least a portion of the length of the rest portion and may form a V-shaped trough along at least a portion of the length of the rest portion.

In some embodiments, the bifurcated cavity forms one or more pairs of lobes.

The rest portion may be bendable along the length, which is facilitated by using pliable materials and, in cases where the rest portion includes an internal cavity, a deformable media within the cavity.

In some instances, the internal cavity contains granular media that includes one or more of beans, rice, corncob media, beads, or sand. Additionally or alternatively, the media includes one or more of a gel or a foamed material. In some cases, a cellular structure fill material may be used, such as an open celled foam or rubber material. Additionally or alternatively, the internal cavity may include an air bladder that may be inflated to a desired pressure.

In some instances, the rest portion may be made of a deformable material. In an embodiment, the deformable material may be a hyper-elastic polymer. A surface of the rest portion may include a trough or channel or pair of lobes on a surface.

In some cases, the rest portion has a height to width ratio of less than 50%. This low profile allows the firearm sling to be comfortable while carrying the firearm yet allows for quick setup to a shooting position.

In some embodiments, the rest portion is positioned along the sling closer to a front attachment point than a rear attachment point. This may help facilitate the rest portion supporting the gunstock or the barrel without having the detach the sling in order to use the rest portion as a shooting rest.

In some cases, the sling is configured as a two-point sling, but may also be configured as a single-point, three-point, or some other configuration of sling.

According to some embodiments, a padded shooting rest includes a body formed of at least two layers of material and having a first end, a second end, and a length therebetween; a cavity formed between the at least two layers of material; a padding media or air bladder located within the cavity; and a bifurcation along at least a portion of the length, the bifurcation forming a trough along at least the portion of the length.

In some cases, one or more couplings are configured to selectively couple the shooting rest to a firearm sling. The one or more couplings may be located adjacent the first end and the second end, and may include one or more of a buckle, clip, ring, snap, strap, weave, cam, hook and loop fastener, or lock. For example, a spring-loaded clip carried by the padded shooting rest may allow the straps of a sling to pass therethrough and be selectively attached to the sling at any point along the length of the sling.

The padding media may be one or more of beans, rice, corncob media, beads, sand, gel, foam or a hyper-elastic polymer.

In some cases, the shooting rest has a height that is less than 50% of its width.

The body of the shooting rest may be pliable and may be configured to deform along its length, such as for resting on a railing, branch, fence, rock, log, or some other support that is not very flat.

In some cases, the trough has a substantially V-shaped cross section, or a substantially U-shaped cross section, or a substantially X-shaped cross section.

In some embodiments, the body of the shooting rest is configured to be selectively coupled to a firearm sling and slide along the firearm sling to a desired position or removed from the sling.

BRIEF DESCRIPTION OF THE DRAWINGS

The accompanying drawings are part of the disclosure and are incorporated into the present specification. The drawings illustrate examples of embodiments of the disclosure and, in conjunction with the description and claims, serve to explain, at least in part, various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein. Like numbers refer to like, but not necessarily the same or identical, elements throughout.

DETAILED DESCRIPTION

This disclosure generally relates to a system that provides a long gun sling with a padded rest. Slings have long been used to not only provide an efficient strap for carrying a long gun, but also to allow a shooter to stabilize the firearm whether shooting in an off-hand, sitting, kneeling, or prone position.

Slings come in various types, such as a two-point sling in which the sling is connected to the firearm at two points, typically at the front and rear of the gunstock. This type of sling allows a sportsman to carry the firearm over their shoulder or back, with the sling positioned across their torso or over a shoulder. Other slings include a three-point sling, in which the sling is connected to the firearm at three points, and may provide a more secure attachment to the user. Finally, a single-point sling is of a design that allows a user to quickly transition the firearm from one shoulder to another shoulder.

Slings may be made of any suitable material, such as natural materials including leather, cotton, or other suitable textile, as well as synthetic materials such as nylon webbing, nylon composite, neoprene, canvas, polyester, polyvinyl chloride, and polyethylene, among others.

Figure 1:
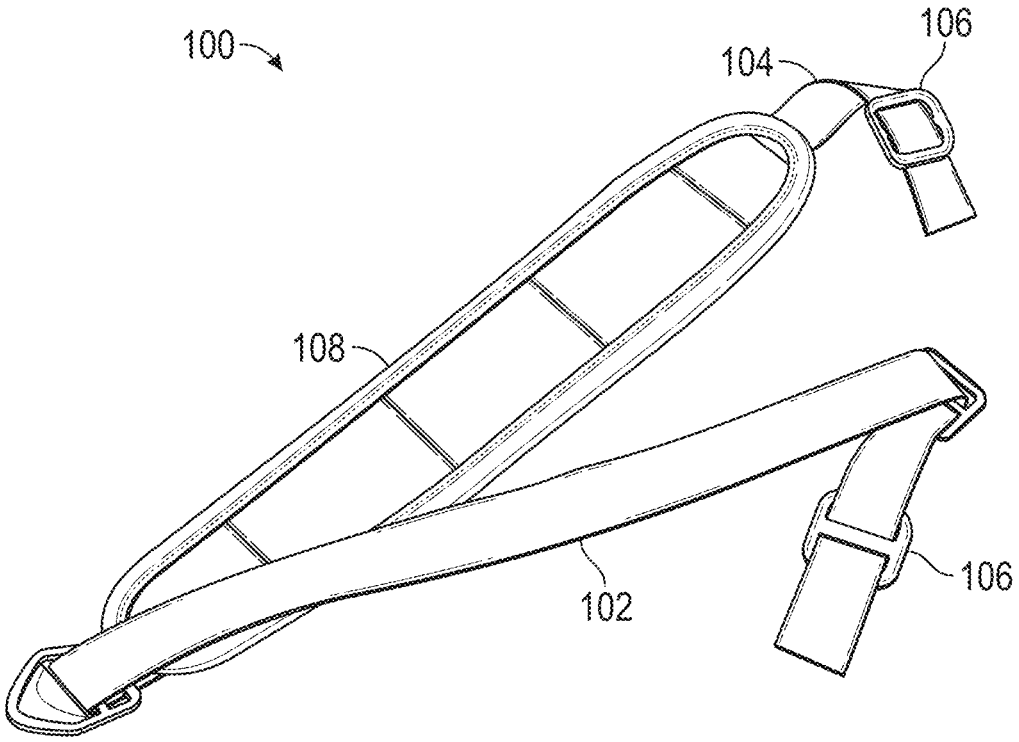
FIG. 1 (Prior Art)
FIG. 1 illustrates a perspective view of a prior art rifle sling.

With reference to FIG. 1, a traditional sling 100 includes a forward strap 104, a rear strap 102 and one or more connectors 106 to enable the sling to connect to the firearm. These connectors 106 may be an attachment clip, a swivel, a buckle, or some other suitable attachment structure that may cooperate with a mount on the firearm that allows the sling to couple to the firearm. A firearm may carry a mount, such as a fixed loop, a swivel loop, an end plate, a quick detach connecter, or some other structure that cooperates with the connector 106 on the sling to couple the sling to the mount.

A sling may additionally have a padded area 108 that provides comfort when the sling 100 is used to carry a firearm, such as over a shoulder to provide padding to the wearer to improve the comfort of carrying the firearm.

In some cases, the sling can also be used to provide stability to the firearm when in use by providing additional stability at the interface between the firearm and the sportsman. For example, a sportsman may use the sling to pull the firearm more securely into the sportsman's body to reduce the need for the user to support most of the weight with their support arm.

A sling can be used to improve marksmanship at distance. However, even with a sling, a long-distance marksman must still support the weight of the firearm with their body which is prone to movement.

One approach that marksmen tend to use, especially for long-range shooting, is to use a bench rest, or a shooting bag, to support much of the weight of the firearm. A shooting bag, also referred to as a shooting rest, is essentially a bag that is placed on a bench, the ground, or some other rigid structure and is used to support much of the weight of the firearm. In some cases, a shooting bag may be filled with a granular material that aids the bag in conforming to the shape of the firearm to provide additional stability and support. However, shooting bags are typically filled with granular media, which can be heavy, and are oftentimes bulky, which make them difficult to pack and carry for longer journeys, especially on foot.

Oftentimes, a sportsman will prefer to pack light when traveling, and oftentimes will opt to leave a shooting bag out of their pack. Moreover, even in those cases in which a sportsman carries a shooting bag, it may often be stored in a backpack, and therefore not easily accessible when the sportsman desires to quickly set up for a shot.

Figure 2:
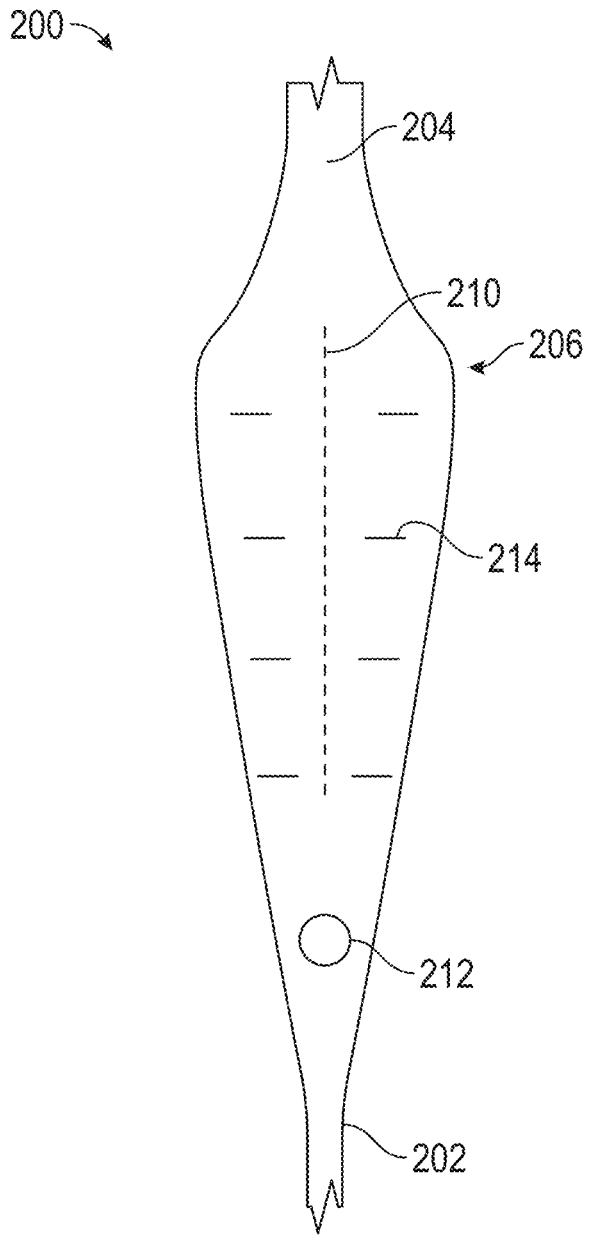
FIG. 2 illustrates a top view of a rifle sling with integrated padded rest, in accordance with some embodiments.

FIG. 2 illustrates a device 200 that is a combination of a rifle sling and a padded shooting rest. The device 200 includes a forward strap 204 and a rearward strap 202. The straps may carry an attachment structure to selectively couple the device 200 to a firearm, as has been described. A rest portion 206 is provided along the length of the device at a location that may be used to provide cushioning to a sportsman when carrying the firearm. In some cases, the rest portion 206 is padded with a suitable material to provide cushioning and/or thickness to the rest portion as will be described hereinafter.

In some embodiments, the rest portion 206 is wider than the straps 202, 204 and thereby supports the weight of the firearm across a larger surface area to reduce the pressure against the user. In some cases, the rest portion 206 may define a trough 210, which may be an area of reduced thickness. The trough 210 may run longitudinally through the rest portion 206. In some cases, the trough 210 is formed by stitching a top material to a bottom material and filling the sides with a padding material. Of course, other methods for forming the trough are contemplated, such as heat welding, gluing, fusing, hook and loop, using a formed material of a suitable shape (e.g., foam or rubberized material) or some suitable method of creating the trough 210.

In some cases, a through hole 212 is formed in the rest portion 206, which may be located near a location where the rest portion 206 meets the forward strap 204, the rearward strap 202, or both. The through hole 212 may be configured to receive a finger of a user, such as the user's thumb, which may be useful in carrying or supporting the firearm.

In some embodiments, one or more baffles 214 are used to further segment the rest portion 206 and/or to help maintain the media in place within the rest portion 206. In some instances, the one or more baffles 214 are formed perpendicular to the trough 210, while in other cases, the baffles are formed at any suitable location and shape and may be formed by stitching through the rest portion 206. In some embodiments, the rest portion 206 is formed of a non-granular material. For instance, a foam or rubberized material may be used for the rest which may be an open-cellular structure. In these cases, the trough may be formed by the shape of the material itself, and in some cases, baffles are not needed where the rest material is not prone to flowing via gravity and accumulating at a location.

Figure 3:
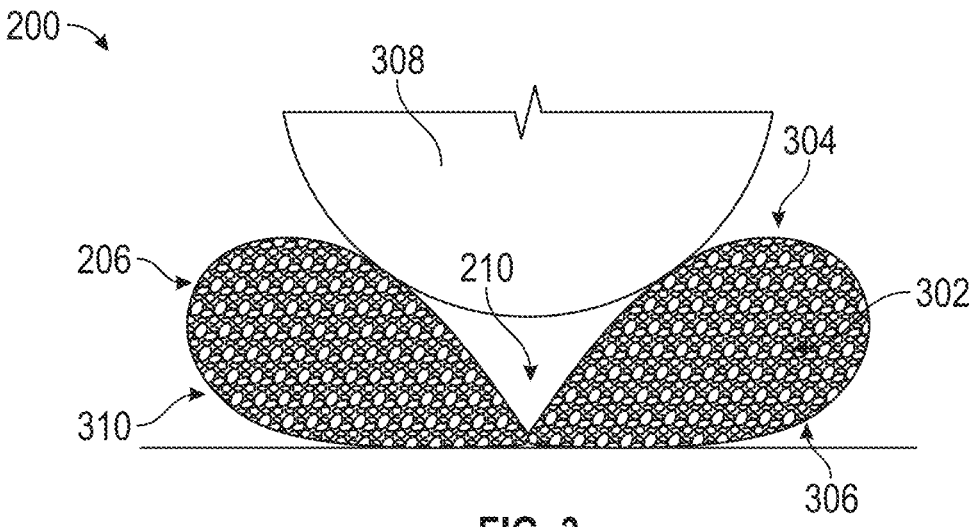
FIG. 3 shows a front view of a rifle sling with padded rest, in accordance with some embodiments.
Figure 4:
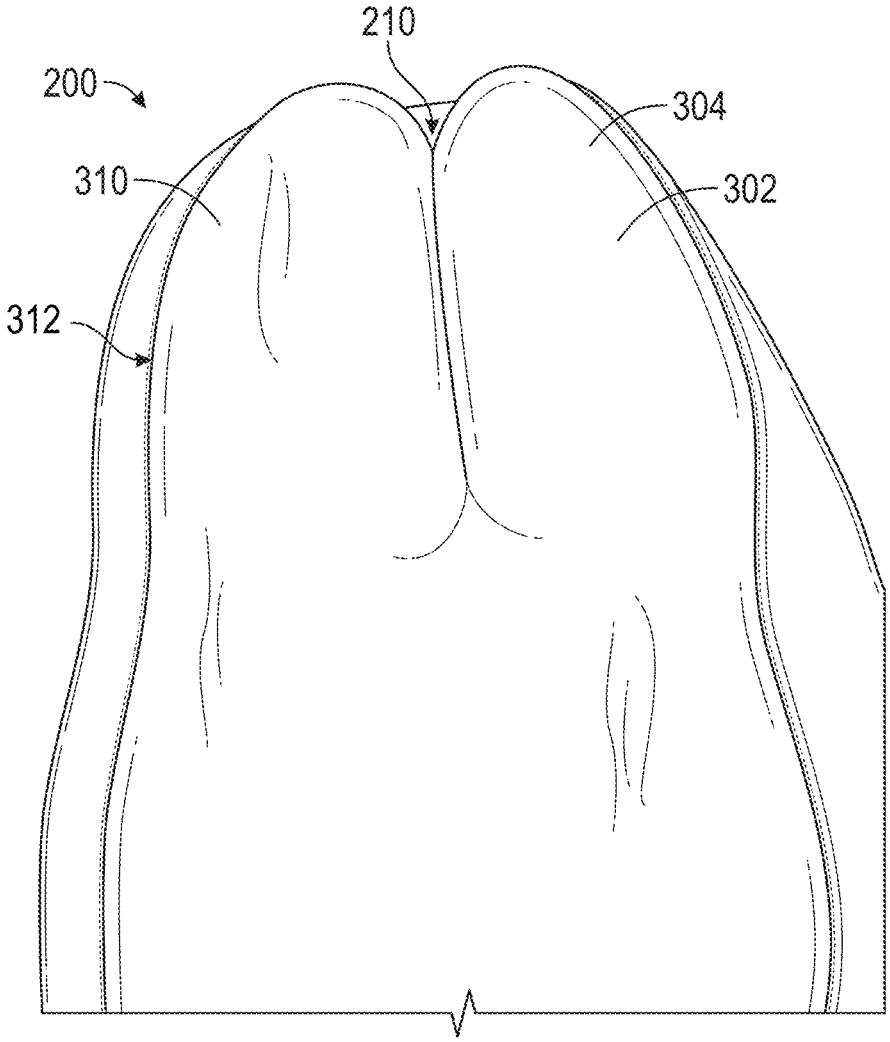
FIG. 4 illustrates a perspective view of a padded rest incorporated into a rifle sling, in accordance with some embodiments.

FIGS. 3 and 4 illustrate an end view of the rest portion 206. According to some embodiments, the rest portion 206 has a chamber 302 that is filled with media. At least a portion of the chamber 302 is bifurcated to create a bifurcated chamber. In some embodiments, the trough 210 bifurcates the chamber 302. For example, a bifurcation may be formed by a material that forms the rest. In some cases, the rest is formed from a non-granular media and may include a foamed material, a gel material, a rubberized material, a composite material, or a combination of materials that is non-granular. In these cases, the material may be formed to have a trough-shape along at least a portion of its length, thereby forming a bifurcation between two sides of the rest.

The chamber 302 has a top material 304 and a bottom material 306 that are arranged to form an inner chamber 302 that can be filled with suitable media. The top material 304 and the bottom material 306 may be a continuous piece of material that has its ends stitched together, such as at the trough 210. The top material 304 and the bottom material 306 may alternatively be different pieces of material and may include the same type of material or different types of material. For instance, the top material may be selected to provide comfort to a sportsman while carrying the firearm, and the bottom material may be selected to provide anti-slip properties of the rest portion 206.

The trough 210 may be formed by any suitable method, and in some cases, the trough 210 creates an area of reduced thickness in comparison with the rest portion 206. In some cases, the trough 210 is formed by stitching, such as adding a suitable stitching down a central region of the rest portion 210 to bring a top material 304 in close proximity to a bottom material 306.

In some embodiments, the trough 210 forms a groove down the longitudinal center of at least a portion of the rest portion. In some cases, the groove is V-shaped, but may also take different shapes, such as substantially U-shaped, X-shaped, FIG. 8 shaped, or some other suitable shape. In some cases, the trough 210 is relatively shallow, and may have a depth that is equal to about 5% to about 10% of the thickness of the rest. Of course, the trough 210 can be any suitable depth, such as about 20%, about 30%, about 40%, about 50%, about 75%, about 80%, or about 90% or more of the thickness of the rest. The trough 210 may include sidewalls that slope inward such that a cylindrical object placed therein (e.g., gun stock or barrel) 308 will have a tendency to be centered in the trough 210. The trough 210 may include an anti-skid feature that inhibits a firearm from sliding or rolling when placed in contact with the trough 210. The anti-skid feature may include a surface texture, such as bumps, grooves, ridges, peaks and valleys, or some other surface treatment. The anti-skid feature may be embossed, imprinted, debossed, or otherwise formed in the upper material of the trough 210. Alternatively or additionally, the anti-skid feature may be attached to the top material 304, and may be of a material that is different than the top material 304. For example, the anti-skid feature may include any of a number of natural material such as suede or synthetic materials, such as silicone, polypropylene, rubber, or other suitable material and may also include a pattern (e.g., ridges, bumps, grooves, etc.) to enhance the anti-skid properties.

The rest portion 206 may define one or more pairs of opposing lobes 310 that are formed by the media within the chamber 302 in combination with the trough 210. The media within the chamber 302 provides thickness to the rest portion 206 and the trough 210 forms a region of reduced thickness. The trough 210 causes the rest portion 206 to bulge upwardly, thereby forming the trough 210 and two or more lobes 310. In cross section, the lobes may be substantially tear-drop shaped, rectangular, ovoid, circular, or some other suitable shape the is configured to bias a gunstock toward the center of the trough 210.

The chamber 302 may be filled with any suitable media. In some embodiments, the chamber 302 is filled with granular media, such as, without limitation, corn cob media, beans, sand, kitty litter, rice, bird seed, pellets, lead shot, rubber, plastic beads (solid or hollow), or gravel. In some embodiments, the chamber 302 may be filled with non-granular deformable media, such as, for example, gel, foam, or other suitable material. In some instances, the chamber 302 may be filled with a combination of materials.

The rest portion 206 may be wider than it is tall. In some instances, the rest portion 206 has a ratio of its height to width that is about 25%, or 50%, or 75%. In some cases, the height to width ratio is less than 50%, which provides a lightweight and low-profile rest portion 206 that is able to provide the benefits detailed herein.

FIG. 4 illustrates an example device 200 in which a top material 304 has been coupled to a lower material 306 by stitching 312 along the respective edges. Similarly, the trough 210 has been formed by stitching along at least a portion of the rest portion 206.

The rest portion 206 may be formed of leather, which may provide comfort for a sportsman carrying a firearm by the device 200, an anti-skid feature from the surface roughness of the leather, and protection to the firearm to inhibit scratching when the gunstock or barrel are placed within the trough 210.

Figure 5:
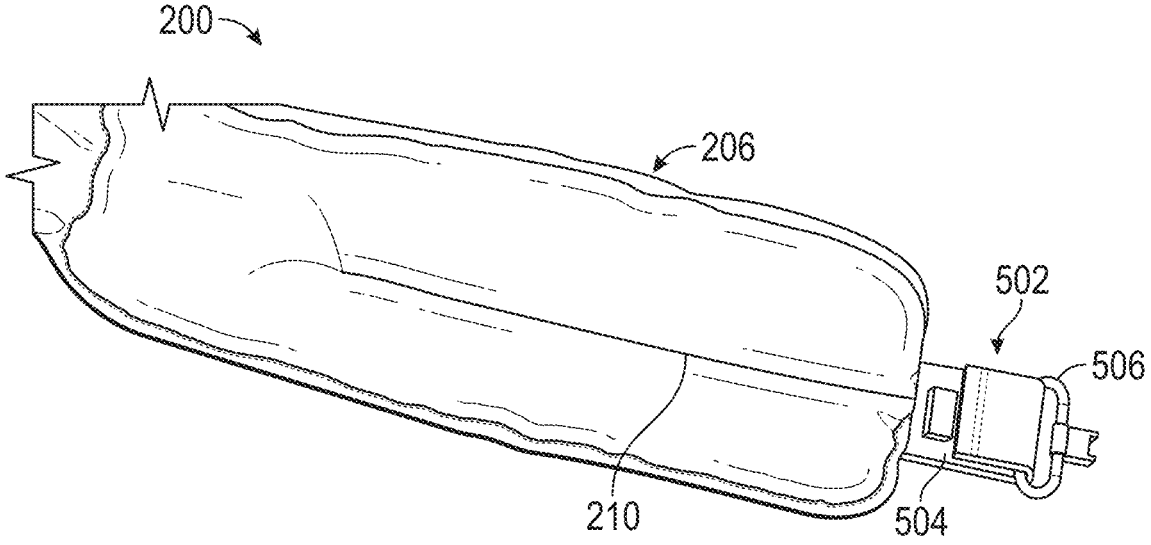
FIG. 5 illustrates a back view of a padded rest incorporated into rifle sling, in accordance with some embodiments.

FIG. 5 illustrates a top view of a device 200 having a rest portion 206 with a trough 210. The rest portion 206 is coupled to a sling 502. The sling has a strap 504 and a connector 506 that allow the device 200 to be selectively coupled to a firearm. In some embodiments, the sling 502 has a forward strap carrying a forward connector and a rearward strap carrying a rear connector.

In some embodiments, the rest portion 206 is located nearer the forward connector than the rear connector. However, the rest portion 206 may be placed at any suitable location along the sling 502. In some instances, the rest portion 206 may be selectively positioned at any suitable location along the sling 502. For example, the sling 502 may pass through one or more attachments (e.g., rings, D-rings, buckles, etc.) associated with the rest portion 206 and the rest portion 206 may slide along the sling 502 to any desirable location along the sling 206.

Figure 6:
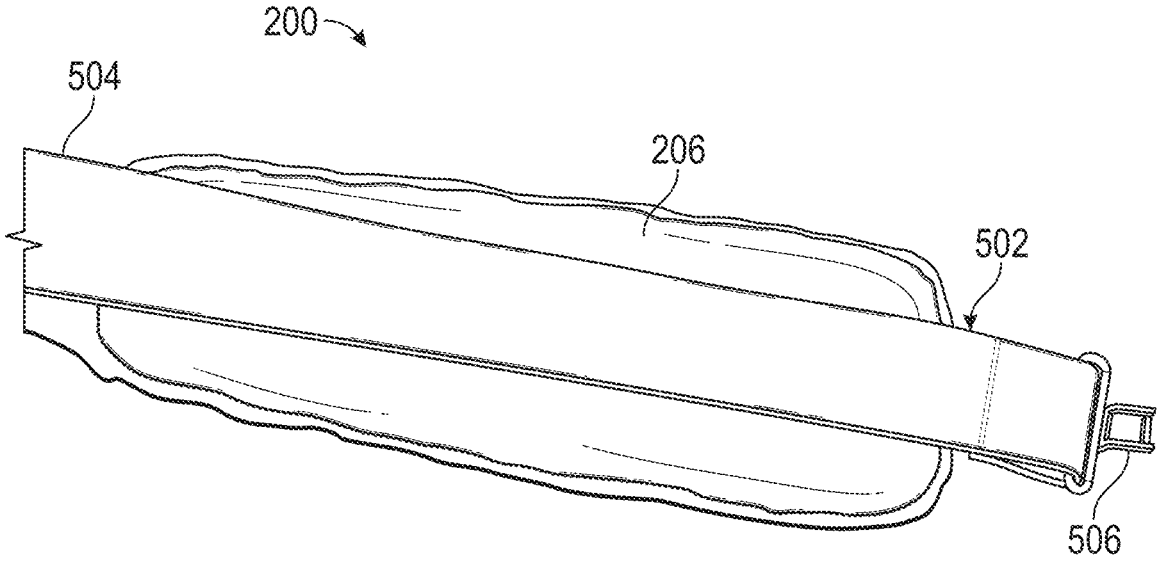
FIG. 6 illustrates a perspective view of a padded rest showing the support cradle, in accordance with some embodiments.

FIG. 6 shows a sling 502 having a strap 504 and a connector 506 for coupling the sling to a firearm. A rest portion 206 is coupled to the sling through any suitable method. In some cases, the rest portion 206 may be stitched to the sling, fastened to the sling by the threading the sling through one or more attachments (e.g., rings, D-rings, buckles, etc.), clipped to the sling, or some other suitable structure for coupling the sling 502 and the rest portion 206. In some examples, the rest portion 206 may selectively attach to the sling by cooperating snaps, hook and loop fastener, modular lightweight load-carrying equipment ("MOLLE") straps, a combination of attachment devices, or some other suitable attachment structure.

Figure 7:
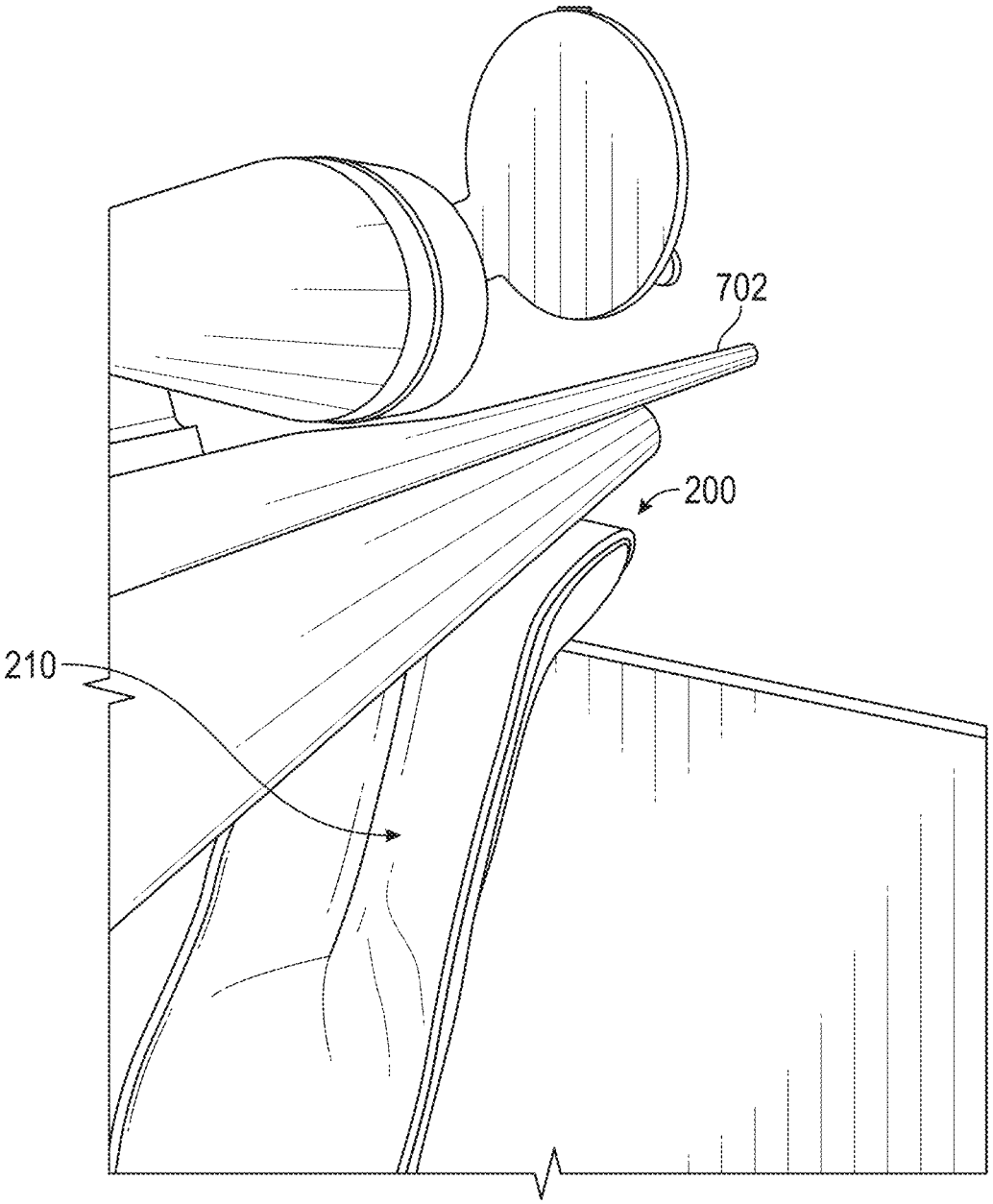
FIG. 7 illustrates a padded rest supporting a long gun on a sill, in accordance with some embodiments.

FIG. 7 illustrates a device 200 in which a long gun 702 has been placed within the trough 210. The device 200 may be placed on a relatively flat surface, such as the ground, a table, or other similar horizontal support. In some cases, the device 200 may be placed on a supporting surface that is not very flat, such as a tree branch or limb, a windowsill, a tree stand, a log, a rock, or other structure. In some cases, the device 200 is configured to bend along its longitudinal axis. In this way, the device 200 is able to provide a stable support for a firearm no matter the underlying structure upon which the device 200 is resting. Similarly, the device 200 may be configured to flex in a direction transverse to its longitudinal axis, which aids the device in achieving stable contact with any of a number of underlying supporting structures that the device 200 may be placed in contact with while providing a stable cradle in which to support a firearm. In either case, the device 200 provides an improved sling having a rest portion 206 that not only provides a cushioned area for comfort when carrying a firearm over a shoulder or across a torso, but also functions as a shooting rest as the rest portion provides a stable cradle to support the firearm in a shooting position.

In some embodiments, the trough may be formed by the deformability of the rest portion 206 and the media within the chamber. For instance, the entire rest portion 206 may have a single chamber that contains a media. There may not be a need for central stitching that proactively forms the trough, but rather, the rest portion 206 may be sufficiently pliable and deformable that, when a firearm is place on the rest portion 206, the rest portion 206 naturally deforms to cradle the firearm and provide a stable shooting rest.

Figure 8A:
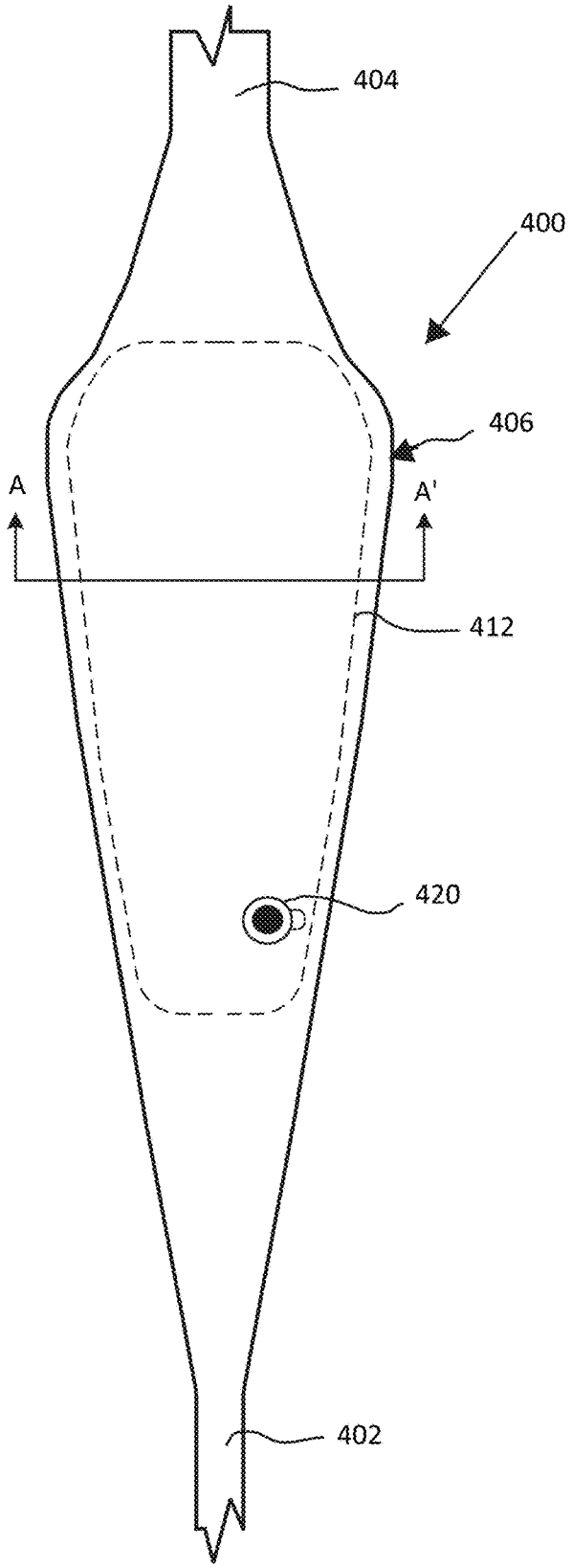
FIG. 8A illustrates a top view of a rifle sling with integrated inflatable padded rest, in accordance with some embodiments.

FIG. 8A illustrates a device 400 that is a combination of a rifle sling and a padded shooting rest. The device 400 includes a forward strap 404 and a rearward strap 402. The straps may carry an attachment structure to selectively couple the device 400 to a firearm, as has been described. A rest portion 406 is provided along the length of the device at a location that may be used to provide cushioning to a sportsman when carrying the firearm. In some cases, the rest portion 406 is inflatable to selectively provide cushioning and/or thickness to the rest portion as will be described hereinafter.

Figure 8B:
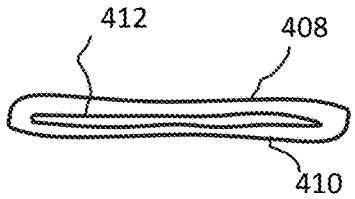
FIG. 8B illustrates a first cross-sectional view of the inflatable padded rest of FIG. 8A, in accordance with some embodiments.
Figure 8C:
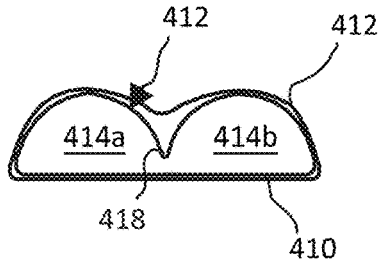
FIG. 8C illustrates a second cross-sectional view of the inflatable padded rest of FIG. 8A, in accordance with some embodiments.
Figure 8D:
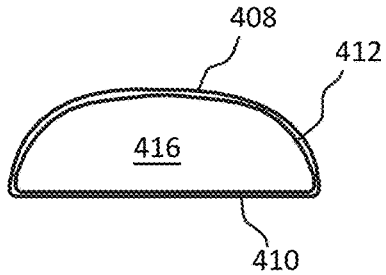
FIG. 8D illustrates a third cross-sectional view of the inflatable padded rest of FIG. 8A, in accordance with some embodiments.

In some embodiments, the rest portion 406 is wider than the straps 402, 404 and thereby supports the weight of the firearm across a larger surface area to reduce the pressure against the user. The rest portion 406 includes an inflatable chamber or bladder 412, which may be disposed within an interior of the rest portion 406 between a top material 408 and a bottom material 410. This is illustrated in FIGS. 8B, 8C and 8D which show various cross-sectional views taken along line A-A' of FIG. 8A. As shown, the air bladder 412 may be disposed between the top material 408 and the bottom material 410, which may be connect in any appropriate manner to enclose the bladder in a chamber within the rest portion.

The air bladder may be selectively inflated and deflated by a user via one or more air valves 420. Such an air valve may be an oral air valve allowing a user to orally inflate the air bladder. Other air valve and inflation means are possible. For instance, a finger pump (not shown) may be incorporated with the bladder 412 to allow a user to inflate the bladder 412 via repeated compression of such a finger pump. Though illustrated extending through the bottom material 410 in FIG. 8A, the location of the valve 420 may be varied. That is, the valve may be positioned (e.g., through a side surface or the top material 408) such that it does not contact a user's shoulder when utilizing the rest portion to carry a firearm.

As illustrated in the embodiment of FIG. 8A, the bladder 412 may be deflated when the device 400 is used to carry a firearm. In this regard, when the device 400 is used as a rifle sling, a user may have a thin, non-cumbersome rest portion 406 for transporting the firearm to a hunting location. Once arriving at a hunting location, the user may inflate the bladder 412 to a desired pressure such that the rest portion may form a padded shooting rest.

FIG. 8B illustrates the inflatable shooting rest in an inflated configurating in an embodiment. As shown, the bladder 412 may include first and second portions forming first and second cavities 414*a*, 414*b* within the bladder that define a trough 418 therebetween, when inflated. The cavities may be in fluid communication with one another (e.g., partially separated by one or more internal baffles) or be fluidly isolated. In the latter regard, each cavity may be a separate bladder and include a separate valve for inflation and deflation. As illustrated, the two cavities 414*a*, 414*b* of the inflated rest portion defines a pair of opposing lobes separated by a trough 420 of reduced thickness. The trough 418 may run longitudinally through a portion or an entirety of the inflatable bladder 412.

FIG. 8C illustrates the inflatable shooting rest in an inflated configurating in another embodiment where the inflatable bladder 412 includes a single internal chamber 416. In such an embodiment, a user may selectively inflate the internal chamber 416 to a desired pressure. At low pressures, the bladder 412 may deflect to cradle a firearm when utilized as a firearm rest.

Figure 9B:
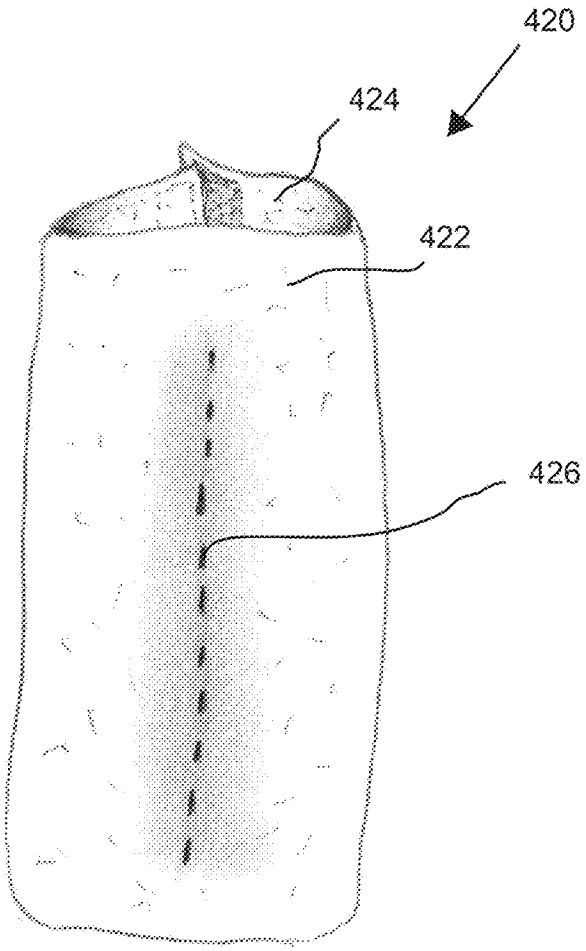
FIGS. 9A and 9B illustrate bottom and top views, respectively, of a shooting rest, in accordance with some embodiments.
Figure 9A:
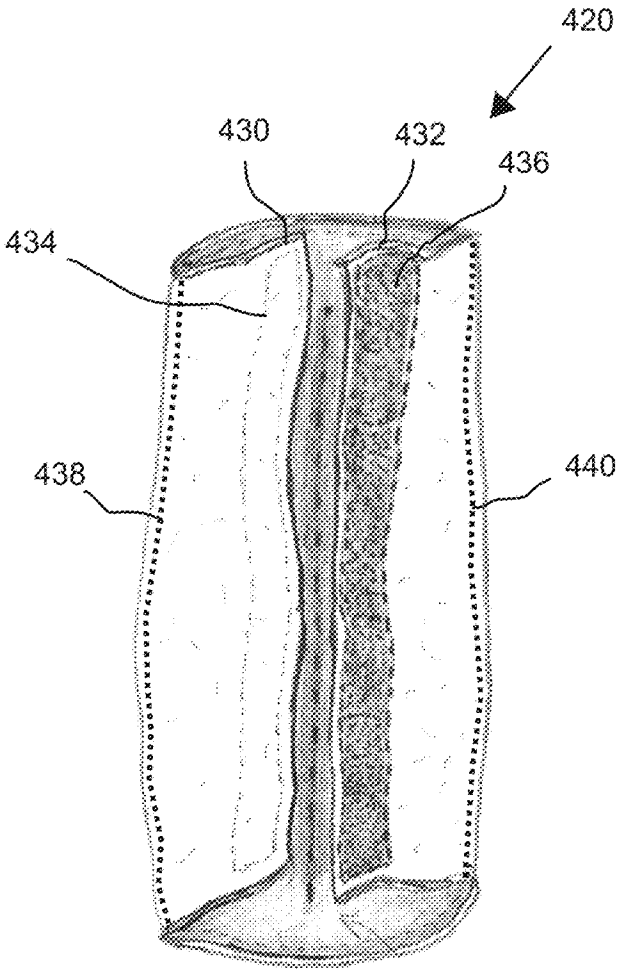
Figure 10:
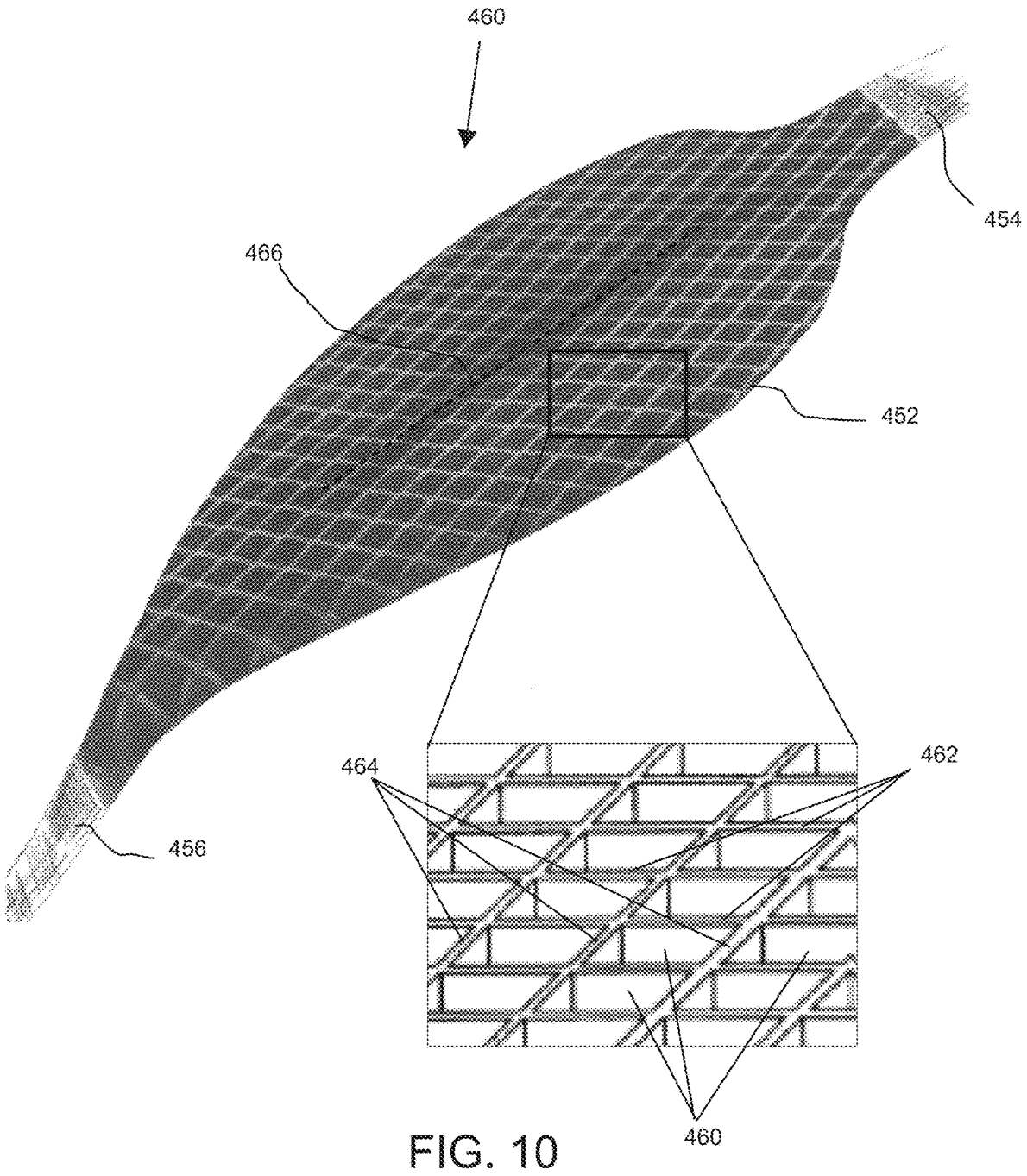
FIG. 10 illustrates a perspective view of a rifle sling with integrated padded rest, in accordance with some embodiments.

FIGS. 9A and 9B illustrate top and bottom view of another embodiment of a of a shooting rest 420. In this embodiment, the shooting rest 420 is what may be termed a wrap-around rest that may be attached around an existing rifle sling or around the forestock and/barrel of a firearm. In the illustrated embodiment, the shooting rest 420 includes an outward facing side (FIG. 9A) and an inward facing side (FIG. 9B). The inward facing side is configured to face a user's shoulder when attached to a sling and to support a firearm when used as a shooting rest while attached to the sling.

In some embodiments, the shooting rest 420 is formed of a top material 422 and a bottom material 424 forming an inner chamber therebetween. The inner chamber that can be filled with suitable media. The top material 422 and the bottom material 424 may be a continuous piece of material or separate pieces of material stitched paving one or more peripheral edges stitched together. The top material and the bottom material may include the same type of material or different types of material. For instance, the top material may be selected to provide comfort to a sportsman while carrying the firearm, and the bottom material may be selected to provide anti-slip properties of the rest portion.

In an embodiment, a trough 426 is formed in the top material 422. The trough 422 may be formed by any suitable method, and in some cases, the trough 422 creates an area of reduced thickness in comparison with the rest portion 420. In some cases, the trough 210 is formed by stitching, such as adding a suitable stitching down a central region of the shooting portion to bring a top material 422 in close proximity to the bottom material 424. The trough 426 may form a groove down the longitudinal center of at least a portion of the shooting rest 420. In some cases, the groove is V-shaped, but may also take different shapes. In some cases, the trough 420 is relatively shallow, and may have a depth that is equal to about 5% to about 10% of the thickness of the shooting rest. However, the trough 426 can be any suitable depth, such as about 20%, about 30%, about 40%, about 50%, about 75%, about 80%, or about 90% or more of the thickness of the shooting rest. The trough may include sidewalls that slope inward such that a cylindrical object placed therein (e.g., gun stock or barrel) will have a tendency to be centered in the trough.

The shooting rest 420 may define one or more pairs of opposing lobes that are formed by media within the internal chamber between the top material 422 and the bottom material 424 in combination with the trough 426. The media within the internal chamber provides thickness to the shooting portion 420 and the trough 426. The internal chamber between the top material 422 and the bottom material 424 may be filled with any suitable media (e.g., deformable media). In some embodiments, the chamber 302 is filled with granular media, such as, without limitation, corn cob media, beans, sand, kitty litter, rice, bird seed, pellets, lead shot, rubber, plastic beads (solid or hollow), or gravel. In some embodiments, the chamber 302 may be filled with non-granular deformable media, such as, for example, gel, foam, hyper-elastic polymers or other suitable material. In some instances, the chamber 302 may be filled with a combination of materials.

In order to attach the shooting rest 420 to a sling or forestock/barrel of a rifle, first and second lateral edges 430, 432 of the shooting rest 420 include mating fasteners. In this regard, the shooting rest 420, which is formed of pliable materials (e.g., pliable top material 422, pliable bottom material 424 and deformable media) may be wrapped around a sling or firearm and connected to itself. In an embodiment, the first lateral edge includes a first fastener 434 and the second lateral edge 432 includes a second fastener 436. In a non-limiting embodiment, these fasteners are mating hook and loop fasteners. However, other fasteners (snaps, buttons, zippers etc.) may be utilized.

In an embodiment, additional lines of stitching 438, 440 may extend between the top material 422 and bottom material 424. In such an embodiment, the padded area and trough defined by media in the internal chamber between the top material 422 and bottom material 424 may be mostly or entirely confined to the inward facing side configured to face a user's shoulder when attached to a sling (e.g., FIG. 9B) while the outward facing side configured to wrap around the sling or firearm forestock/barrel may be mostly or entirely free of media between the top material 422 and bottom material 424. In an alternate embodiment, an air bladder may be disposed between the top material 422 and bottom material 424 in a configuration similar to the embodiments of FIGS. 8A-8C FIG. 10 illustrates a perspective view of another embodiment of a rifle sling 450 with integrated padded rest portion 452. In the illustrated embodiment, the rest portion 452 is wider than straps 454, 456 and thereby supports the weight of the firearm across a larger surface area to reduce the pressure against the user. In this embodiment, the padded rest portion if formed from a plurality of open voids 460 formed by a first plurality of sidewalls 462 and a second plurality of intersecting sidewalls 464. The open voids 460, in an embodiment, are disposed on an inward facing side of the sling 450 configured to face a user's shoulder. A backing material (not shown) may be formed on an outward facing side of the sling.

To providing cradling of the firearm when utilizing the rest portion 452 to support a firearm, the sidewalls 462, 464 are configured to deflect or buckle. In this regard, the sidewalls may be formed of compressible materials including, without limitation, foams (e.g., open celled or closed cell) as well as hyper-elastic polymers. When a firearm is supported on the array of open voids 460, the sidewalls deflect/buckle to cradle the firearm. Such an embodiment may provide an effective firearm rest without a trough formed within the rest portion 452. However, an optional trough 466 may be formed in the inward surface of the rest portion 452.

Figure 11:
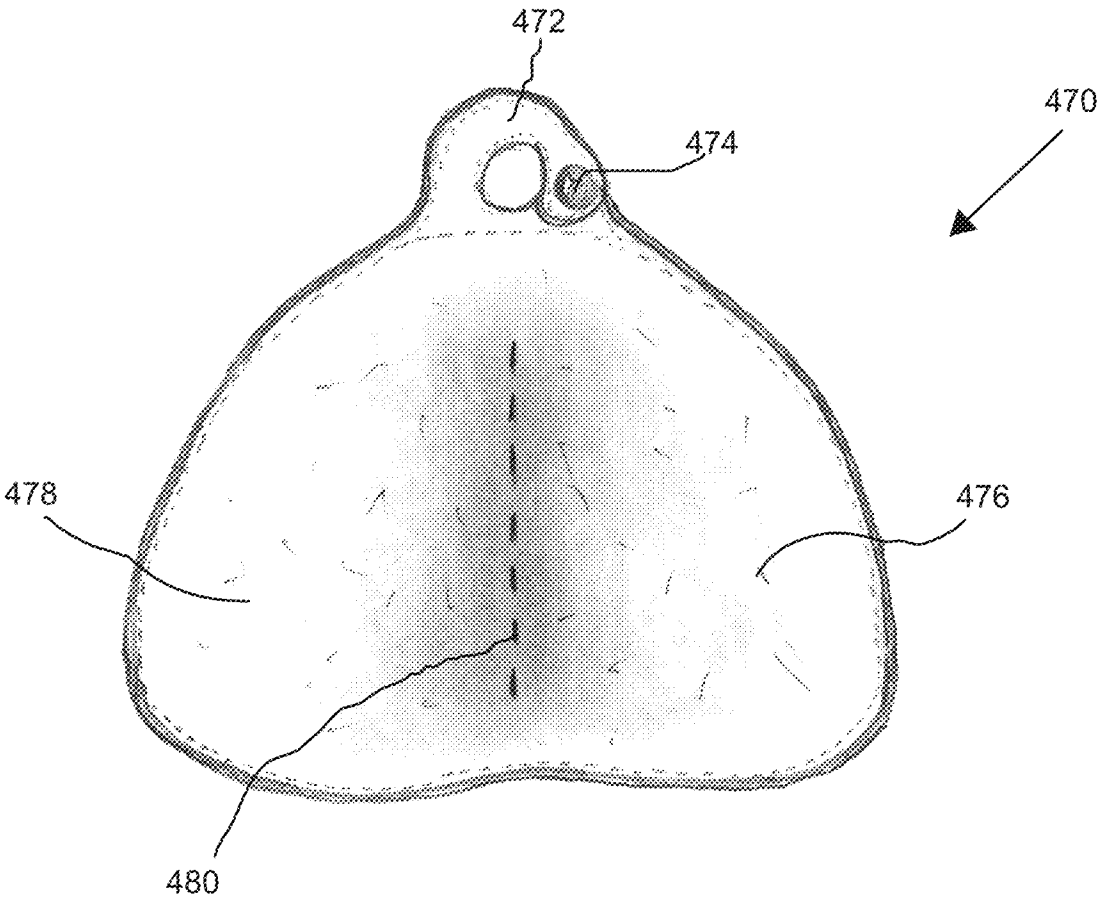
FIG. 11 illustrates a shooting rest, in accordance with some embodiments.
Figure 12:
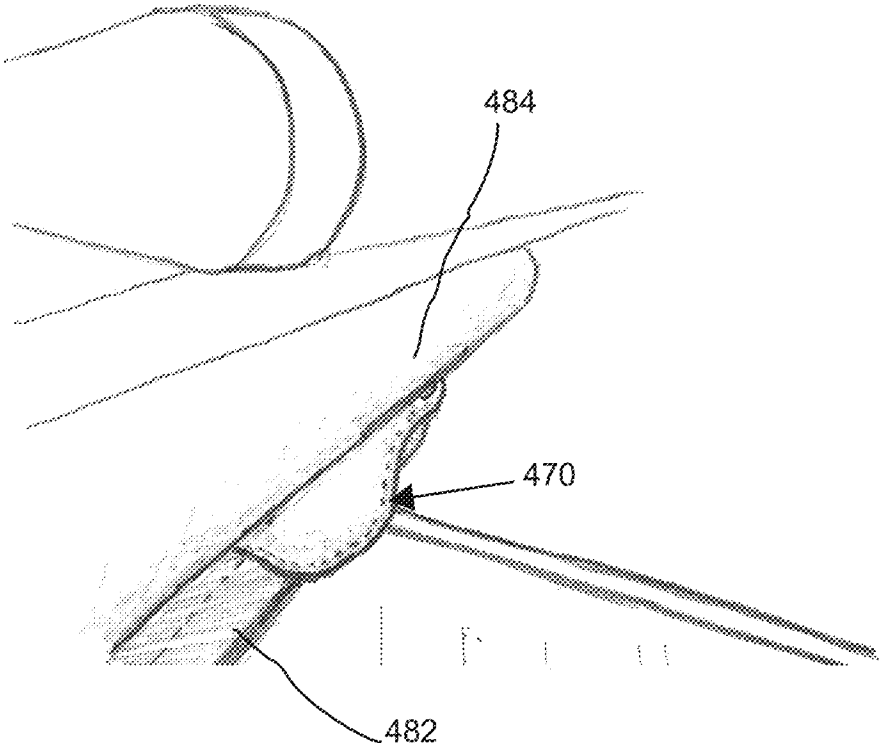
FIG. 12 illustrates the shooting rest of FIG. 11 supporting a long gun, in accordance with some embodiments.

Though the sidewalls 460, 462 are illustrated as being oriented in two directions and intersecting at right angles (e.g., defining square voids 460), it will be appreciated that the sidewalls 462, 464 may intersect one another at other angles and/or define and define voids of other shapes, such as triangles, parallelograms, hexagons, etc. FIG. 11, illustrates another embodiment of a shooting rest 470. In this embodiment, the shooting rest 470 is configured for attachment to a forward sling attachment point of a firearm/rifle. That is, the shooting rest need not be attached to a sling. The shooting rest includes an attachment loop 472 and connector 474 (e.g., snap, button etc.) that may be disposed around the forward sling attachment point, for example, once a sling has been attached to the attachment point. The shooting rest 470 may rest between a sling 482 and a forestock 484 of a firearm when attached. See FIG. 12.

Referring again to FIG. 11, the shooting rest 470 includes first and second lobes 476, 480 separated by a trough 480. Similar to the embodiments above, the shooting rest may be formed of an upper material and a lower material that are attached to define an internal cavity that may be filled with a deformable media. Alternatively, the shooting rest may be formed of material similar to the open void material discussed in relation to FIG. 10.

In use, the sling need not to be detached from the firearm in order to use any of the rest portions discussed above. For example, in some instances, the rest portion is positioned adjacent the gunstock or the barrel when the device is attached to the firearm. As such, when a marksman desires to use the rest portion to support the firearm, there is no need to detach the sling from the firearm; rather, while leaving the device attached to the firearm, the marksman need only position the gunstock or the barrel onto the rest portion. This can be done by placing the rest portion on any suitable underlying support (e.g., the ground, tree stand, hand railing, log, branch, etc.) and placing the firearm onto the rest portion. The result is a firearm sling combined with a shooting rest that improves comfort, stability, efficiency, is lightweight and easy to use.

The disclosure sets forth example embodiments and, as such, is not intended to limit the scope of embodiments of the disclosure and the appended claims in any way. Embodiments have been described above with the aid of representative shapes, construction techniques, and materials. The boundaries of these examples have been arbitrarily defined herein for the convenience of the description. Alternate boundaries can be defined to the extent that the specified functions and relationships thereof are appropriately performed.

The foregoing description of specific embodiments will so fully reveal the general nature of embodiments of the disclosure that others can, by applying knowledge of those of ordinary skill in the art, readily modify and/or adapt for various applications such specific embodiments, without undue experimentation, without departing from the general concept of embodiments of the disclosure. Therefore, such adaptation and modifications are intended to be within the meaning and range of equivalents of the disclosed embodiments, based on the teaching and guidance presented herein. The phraseology or terminology herein is for the purpose of description and not of limitation, such that the terminology or phraseology of the specification is to be interpreted by persons of ordinary skill in the relevant art in light of the teachings and guidance presented herein.

The breadth and scope of embodiments of the disclosure should not be limited by any of the above-described example embodiments, but should be defined only in accordance with the following claims and their equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include these features.

The specification and annexed drawings disclose examples of devices that provide improved comfort, support, and efficiency for a marksman. It is, of course, not possible to describe every conceivable combination of elements and/or methods for purposes of describing the various features of the disclosure, but those of ordinary skill in the art recognize that many further combinations and permutations of the disclosed features are possible. Accordingly, various modifications may be made to the disclosure without departing from the scope or spirit thereof. Further, other embodiments of the disclosure may be apparent from consideration of the specification and annexed drawings, and practice of disclosed embodiments as presented herein. Examples put forward in the specification and annexed drawings should be considered, in all respects, as illustrative and not restrictive. Although specific terms are employed herein, they are used in a generic and descriptive sense only, and not used for purposes of limitation.

What is claimed is:

1. A firearm sling, comprising:

a strap having a first end and a second end;

a rest portion coupled to or integrated with the strap, the rest portion formed of a pliable top material and a pliable bottom material and comprising:

an internal air bladder disposed between the pliable top material and the pliable bottom material of the rest portion; and a valve configured to selectively introduce air into the internal air bladder, wherein a user may selectively inflate the internal air bladder to provide a shooting rest for supporting a firearm; and wherein the pliable top material, the pliable bottom material and the air bladder bend along the length in a first direction to allow the top material to at least partially conform about a shoulder of a user when carrying a firearm and bend along the length in a second direction to at least partially conform to an underlying support contacting the pliable bottom material when supporting the firearm on the pliable top material.

2. The firearm sling as in claim 1, further comprising a first attachment positioned near the first end, and a second attachment positioned near the second end, the first attachment and second attachment configured to selectively couple the firearm sling to a firearm.

3. The firearm sling as in claim 1, wherein the air bladder at least partially defines first and second lobes with a trough disposed therebetween when inflated.

4. The firearm sling as in claim 1, wherein the air bladder comprises a single inflatable chamber.

5. The firearm sling of claim 1, wherein, when the air bladder is deflated, the rest portion is substantially flat.

* * * * *